US006598879B2

(12) United States Patent
Spur et al.

(10) Patent No.: US 6,598,879 B2
(45) Date of Patent: Jul. 29, 2003

(54) METHOD OF PLAYING BLACKJACK WITH HIT INSURANCE

(75) Inventors: Mark John Spur, Zephyr Cove, NV (US); Brian Keith Foster, Stateline, NV (US)

(73) Assignee: Multishift, Inc., Stateline, NV (US)

( * ) Notice: Subject to any disclaimer, the term of this patent is extended or adjusted under 35 U.S.C. 154(b) by 0 days.

(21) Appl. No.: 09/954,615

(22) Filed: Sep. 17, 2001

(65) Prior Publication Data

US 2003/0052452 A1 Mar. 20, 2003

(51) Int. Cl.[7] ..... A63F 1/00
(52) U.S. Cl. ..... 273/292
(58) Field of Search ..... 273/292, 274, 273/309; 463/12, 13

(56) References Cited

U.S. PATENT DOCUMENTS

| | | | | |
|---|---|---|---|---|
| 5,174,579 A | | 12/1992 | Griffiths | |
| 5,257,810 A | | 11/1993 | Schorr et al. | |
| 5,275,416 A | | 1/1994 | Schorr et al. | |
| 5,454,570 A | | 10/1995 | Karal | |
| 5,586,766 A | | 12/1996 | Forte et al. | |
| 5,632,485 A | | 5/1997 | Woodland et al. | |
| 5,636,843 A | | 6/1997 | Roberts | |
| 5,660,391 A | | 8/1997 | Klasee | |
| 5,673,917 A | | 10/1997 | Vancura | |
| 5,707,285 A | * | 1/1998 | Place et al. | 463/12 |
| 5,743,532 A | | 4/1998 | Lafferty | |
| 5,791,989 A | | 8/1998 | Slinkman | |
| 5,806,846 A | | 9/1998 | Lofink et al. | |
| 5,816,575 A | | 10/1998 | Keller | |
| RE35,968 E | | 11/1998 | Prerost | |
| 5,829,750 A | | 11/1998 | Booker | |
| 5,836,586 A | | 11/1998 | Marks et al. | |
| 5,839,730 A | | 11/1998 | Pike | |
| 5,934,998 A | | 8/1999 | Forte et al. | |
| 6,000,699 A | | 12/1999 | Long | |

OTHER PUBLICATIONS

"Blackjack" Scarne's Encyclopedia of Games, Harper & Row Publishers, pp. 276–286, 1973.*
Maverick Blackjack, 1995.*
Hemenway, J., *Bustproof Blackjack,* 1996.

* cited by examiner

*Primary Examiner*—Benjamin H. Layno
(74) *Attorney, Agent, or Firm*—Skinner, Watson & Rounds

(57) ABSTRACT

A method of playing Blackjack is disclosed wherein the player can wager that his hand will be broken by placing a side bet which is referred to as "Hit Insurance". Two aspects of the invention are disclosed. The first aspect allows the player to place the side bet after he has seen his initial hand. If the player has 12 through 16 and the dealer has seven through ace as the upcard, the player is given the option of placing the side bet that he will be broken when he receives the hit card. In a first variation, the player places a side bet against a single hit and can renew the bet if he loses on the hit. In a second variation, the player places a side bet against multiple hits. In a second aspect of the invention, the player places a side bet before he is dealt any cards. In a first variation, the side bet loses if the dealer has 2 through 6 as the face card. In a second variation, the side bet pushes if the dealer has 2 through 6 as the up card. The second aspect of the invention may or may not have Blackjack insurance included in the side bet.

75 Claims, 7 Drawing Sheets

10
PLAYER MAKES WAGER
12
CARDS DEALT
14
DEALER ACE UP
16
DEALER 2-9 UP
18
DEALER 10 UP
20
NO INSURANCE
22
BJ INSURANCE
38
NO BJ
40
DEALER BJ
24
DEALER BJ
26
NO BJ
28
DEALER BJ
30
NO BJ
42
PLAYER LOSES OR PUSHES
32
PLAYER LOSES OR PUSHES
34
REGULAR BET LOSES BJ INS. WINS
36
INS. LOSES
44
PLAYER HITS
46
PLAYER STANDS
48
PLAYER BREAKS
50
DEALER HAND DETERMINED
52
DEALER MAKES HAND
54
DEALER BREAKS
56
COMPARE HANDS
58
PLAYER LOSES
60
PUSH
62
PLAYER WINS

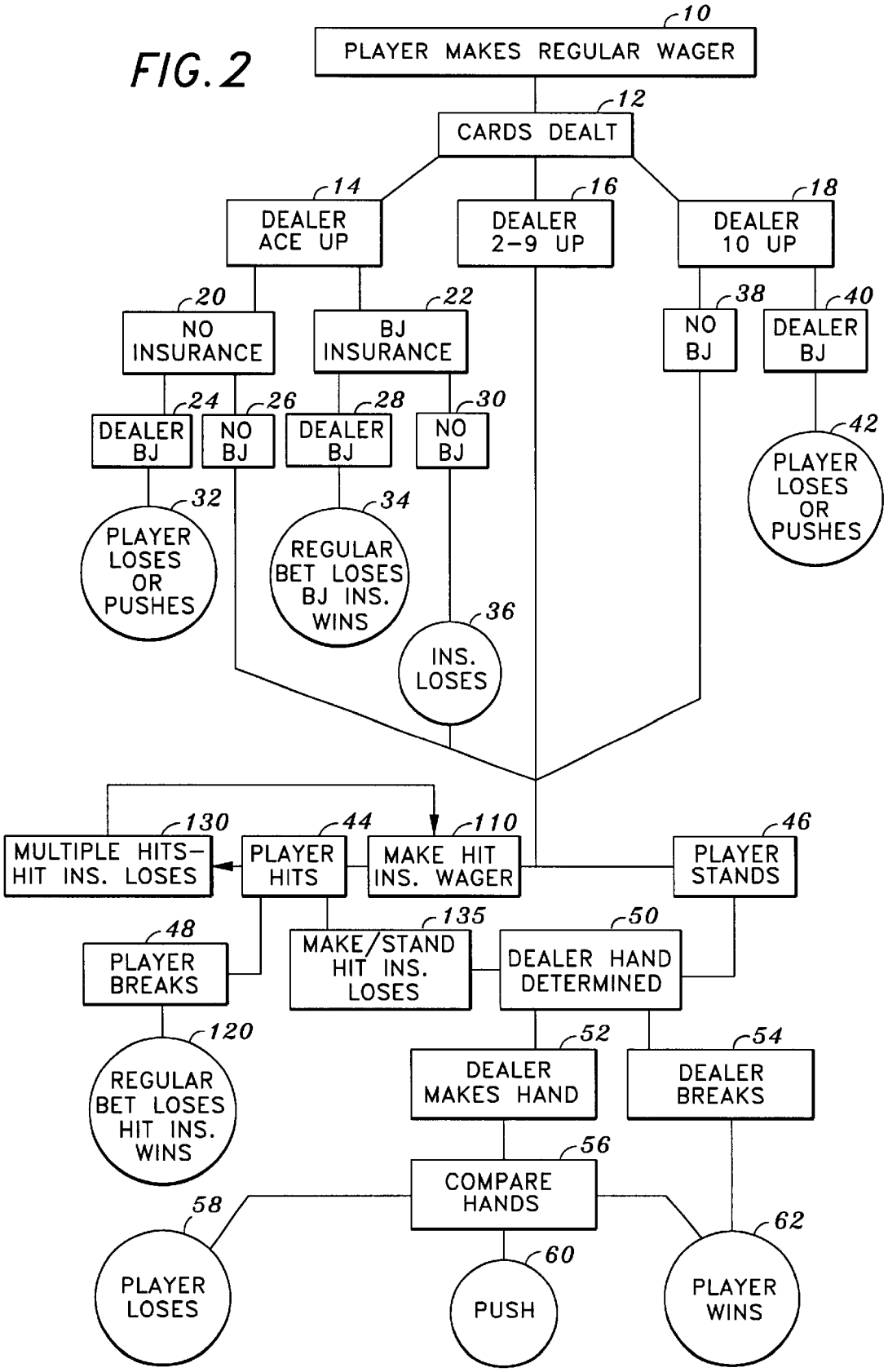
FIG. 2
10
PLAYER MAKES REGULAR WAGER
12
CARDS DEALT
14
DEALER ACE UP
16
DEALER 2-9 UP
18
DEALER 10 UP
20
NO INSURANCE
22
BJ INSURANCE
38
NO BJ
40
DEALER BJ
24
DEALER BJ
26
NO BJ
28
DEALER BJ
30
NO BJ
42
PLAYER LOSES OR PUSHES
32
PLAYER LOSES OR PUSHES
34
REGULAR BET LOSES BJ INS. WINS
36
INS. LOSES
130
MULTIPLE HITS-HIT INS. LOSES
44
PLAYER HITS
110
MAKE HIT INS. WAGER
46
PLAYER STANDS
48
PLAYER BREAKS
135
MAKE/STAND HIT INS. LOSES
50
DEALER HAND DETERMINED
120
REGULAR BET LOSES HIT INS. WINS
52
DEALER MAKES HAND
54
DEALER BREAKS
56
COMPARE HANDS
58
PLAYER LOSES
60
PUSH
62
PLAYER WINS

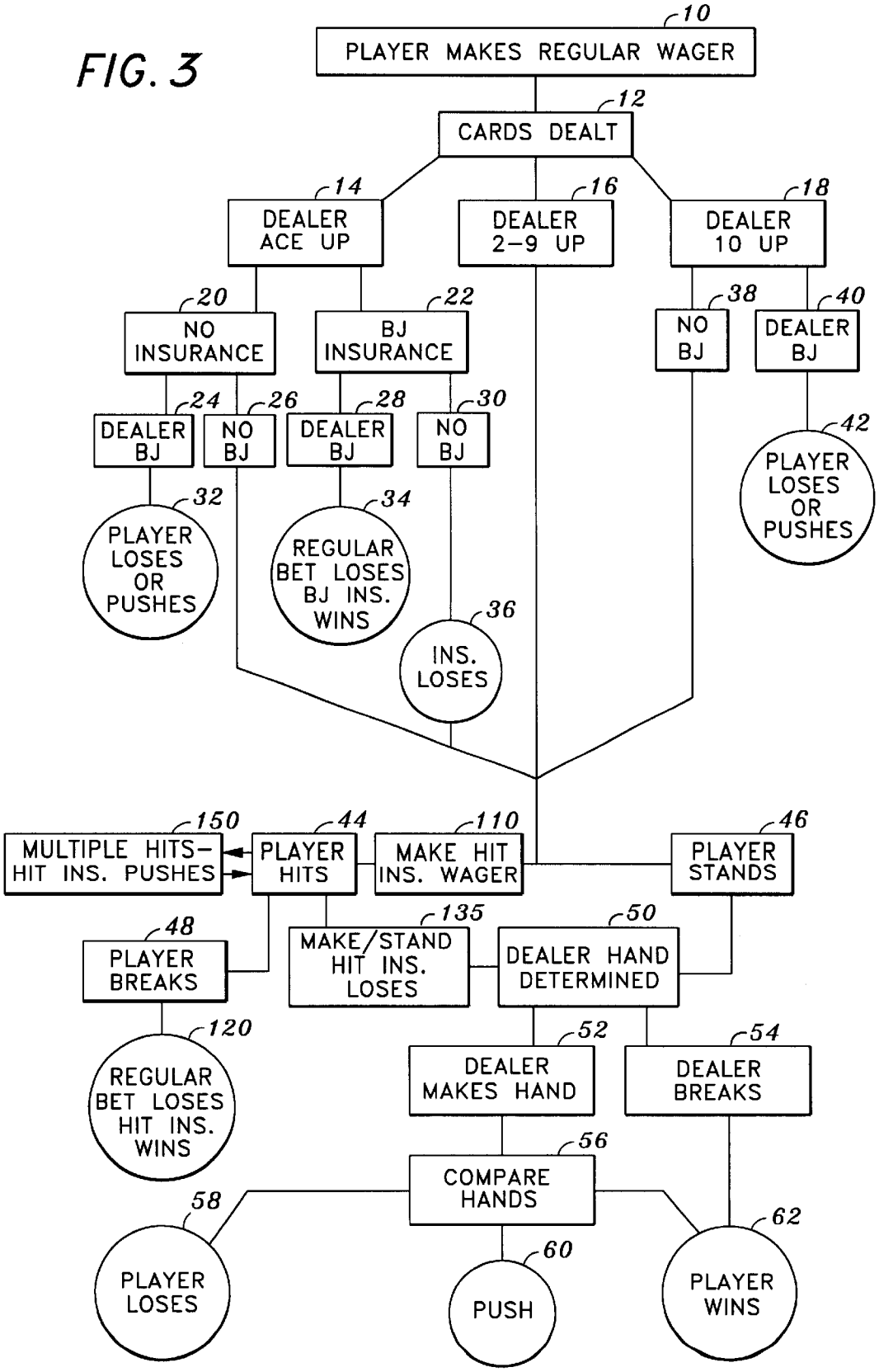
FIG. 3
10
PLAYER MAKES REGULAR WAGER
12
CARDS DEALT
14
DEALER ACE UP
16
DEALER 2–9 UP
18
DEALER 10 UP
20
NO INSURANCE
22
BJ INSURANCE
38
NO BJ
40
DEALER BJ
24
DEALER BJ
26
NO BJ
28
DEALER BJ
30
NO BJ
42
PLAYER LOSES OR PUSHES
32
PLAYER LOSES OR PUSHES
34
REGULAR BET LOSES BJ INS. WINS
36
INS. LOSES
150
MULTIPLE HITS–HIT INS. PUSHES
44
PLAYER HITS
110
MAKE HIT INS. WAGER
46
PLAYER STANDS
48
PLAYER BREAKS
135
MAKE/STAND HIT INS. LOSES
50
DEALER HAND DETERMINED
120
REGULAR BET LOSES HIT INS. WINS
52
DEALER MAKES HAND
54
DEALER BREAKS
56
COMPARE HANDS
58
PLAYER LOSES
60
PUSH
62
PLAYER WINS

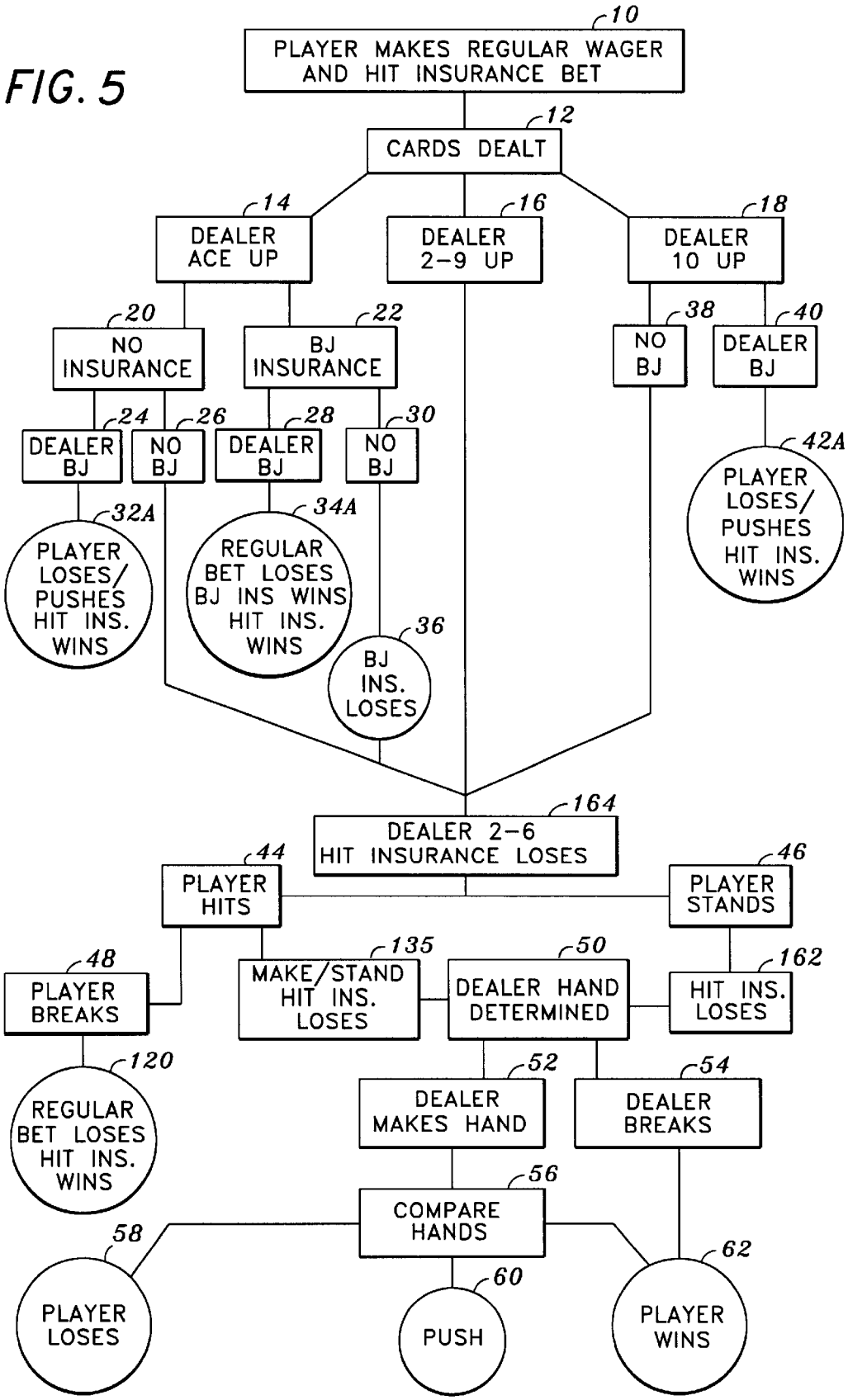
FIG. 5
10
PLAYER MAKES REGULAR WAGER AND HIT INSURANCE BET
12
CARDS DEALT
14
DEALER ACE UP
16
DEALER 2-9 UP
18
DEALER 10 UP
20
NO INSURANCE
22
BJ INSURANCE
38
NO BJ
40
DEALER BJ
24
DEALER BJ
26
NO BJ
28
DEALER BJ
30
NO BJ
42A
PLAYER LOSES/ PUSHES HIT INS. WINS
32A
PLAYER LOSES/ PUSHES HIT INS. WINS
34A
REGULAR BET LOSES BJ INS WINS HIT INS. WINS
36
BJ INS. LOSES
164
DEALER 2-6 HIT INSURANCE LOSES
44
PLAYER HITS
46
PLAYER STANDS
48
PLAYER BREAKS
135
MAKE/STAND HIT INS. LOSES
50
DEALER HAND DETERMINED
162
HIT INS. LOSES
120
REGULAR BET LOSES HIT INS. WINS
52
DEALER MAKES HAND
54
DEALER BREAKS
56
COMPARE HANDS
58
PLAYER LOSES
60
PUSH
62
PLAYER WINS

METHOD OF PLAYING BLACKJACK WITH HIT INSURANCE

BACKGROUND OF THE INVENTION

The present invention relates to a method of playing a Blackjack game. More specifically it relates to a modification of the method of playing a Blackjack game. The modification to the game involves the placing of a side bet to the traditional Blackjack game. The side bet wagers that the player's hand will total over 21 after the player has been hit.

The conventional casino Blackjack table is a half-circle with one curved side for the players to stand or sit and a straight side where the dealer stands or sits. Most conventional Blackjack tables have five, six or seven player positions. Each player position has a single "21" wager box.

As used in this patent application the terms "conventional Blackjack" and "the conventional manner of play of Blackjack" means the game of Blackjack as described on pages 276–282 of Scarne's Encyclopedia of Games by John Scarne, Harper & Row publishers and as described and incorporated herein by reference.

In conventional Blackjack, at least one standard deck of 52 playing cards is used and each card counts its face value. The only exceptions are Aces which have a value of one or eleven as is most beneficial to the count of the player's hand and face cards which have a value of ten. The player's object of the game is to get a higher count (total value of cards in hand) than the dealer's hand, but not over 21.

In the conventional or traditional game of Blackjack, a "21" wager is made by each player before the start of the deal. When the dealer's final hand is closer to 21, but not over, or the player busts, the player loses that wager. When the player wins that wager, the dealer pays the player an amount equal to the player's "21" wager. However, if the player gets a "natural" blackjack hand, the dealer pays the player one and one-half times the amount of the player's wager. Those skilled in the art know that individual casinos pay larger odds and/or various bonuses in addition to the conventional payoffs.

The sequence of play is shown by the flowchart in FIG. 1. As indicated by step 10, the player makes the Blackjack wager. The dealer then deals the cards in step 12. In the dealing procedure, each player initially receives two cards. The dealer also receives two cards. One of the dealer's cards is dealt face-down and the other face-up. In some casinos, the dealer receives his two cards at the same time that each player is dealt his two cards. In other casinos, the dealer initially only receives one card which becomes the dealer's face-up card. The dealer receives his second card after each player has taken additional cards.

There are three situations to be considered after the hands are dealt. The first situation is when the dealer's face card is an ace. This situation is shown in step 14. The second situation is when the dealer's face card has a value of 2 through 9. This situation is shown in step 16. Finally, the third situation is when the dealer's face card is a 10 or a picture card whose value is also 10. This situation is shown in step 18. Depending on the above three situations, various outcomes are possible as described below.

Referring now to step 14, if the dealer has an Ace as an upcard, the player is given the option of placing a side bet known as Blackjack insurance that the dealer's second card will result in the dealer having a Blackjack. A description of the Blackjack insurance is given below. The actions pertaining to the Blackjack insurance are shown in steps 20 and 22. Step 20 indicates that the player has not placed the Blackjack insurance bet. Step 22 indicates that the player has placed the Blackjack insurance bet. After the player has or has not placed the Blackjack insurance bet in boxes 20 and 22, the dealer shows his hand as indicated in steps 24, 26, 28, and 30. In step 24, the dealer is represented to have a Blackjack after the player has not taken Blackjack insurance. In this case, the player loses the regular bet as indicated in step 32 and the game is over.

Alternatively, the player pushes the bet if he too has a Blackjack. In step 28, the dealer is represented to have a Blackjack after the player has taken Blackjack insurance. In this case, the player loses the regular bet and wins on the Blackjack insurance as indicated in result circle 34 and the game is over. Alternately, in step 26, the dealer is represented to not have a Blackjack after the player has not taken Blackjack insurance. In this case, neither the dealer nor the player wins or loses and the game proceeds to the next stage where the player either stands on his hand as indicated in step 46 or requests hit cards as indicated in step 44. In step 30, the dealer is represented to not have a Blackjack after the player has taken Blackjack insurance. In this case, the player keeps the regular bet and loses on the Blackjack insurance as indicated in step 36 and the game proceeds to the next stage where the player either stands on his hand as indicated in step 46 or requests hit cards as indicated in step 44.

Returning now to the second situation shown in step 16 where the dealer has a 2–9 as an upcard, the game proceeds to the next stage where the player either stands on his hand as indicated in step 46 or requests hit cards as indicated in step 44.

Returning now to the third situation shown in step 18 where the dealer has a 10 as an upcard, the dealer then checks his hole card. If the dealer does not have a Blackjack as shown in step 38, the game proceeds to the next stage where the player either stands on his hand as indicated in step 46 or requests hit cards as indicated in step 44. If the dealer has a Blackjack as shown in step 40, the player loses the regular bet as indicated by step 42. Alternately, the player pushes the bet if he too has a Blackjack.

At the next stage of the game, as noted above, the player starts by either standing on his hand as indicated in step 46 or by requesting one or more cards (hit/hits) as indicated by step 44. The dealer can also take additional cards to make his hand. This aspect is not shown in the flowchart, but is well known as being a part of the game. After the dealer has taken his additional cards, the dealer shows his hand as indicated by step 50. If the dealer breaks as shown in step 54, the player wins the regular bet as shown in step 62. If the dealer does not break but instead makes a hand as shown in step 52, the player's and the dealer's hands are compared as shown in step 56. If the player's hand is closer to 21 than the dealer's hand, the player wins as shown in step 62. If both the dealer and the player have equal hand, the result is a push as indicated by step 60. If the dealer's hand is closer to 21 than the player's hand, the player loses as shown in step 58.

Returning now to the situation where the player requests additional cards as shown in step 44, two outcomes are possible. If the additional cards result in the player getting a hand with a total greater than 21, the player breaks as shown in step 48. In this case, the player loses as shown in step 58. After the player stops requesting additional cards in step 44, the dealer may take his additional cards to make his hand. After the dealer has taken his additional cards, the dealer shows his hand as indicated by step 50. If the dealer breaks as shown in box 54, the player wins the regular bet as shown in step 62. If the dealer does not break but instead makes a hand as shown in step 52, the player's and the dealer's hands are compared as shown in step 56. If the player's hand is closer to 21 than the dealer's hand, the player wins as shown in step 62. If both the dealer and the player have equal hand, the result is a push as indicated by step 60. If the dealer's hand is closer to 21 than the player's hand, the player loses as shown in step 58.

There are other procedures to the above basic procedure. One well-known procedure is "Doubling Down." When the player's first two cards have a combined value of 10 or 11, or any first two cards in some casinos, the player may "Double Down" on his hand. The player turns both of his cards face-up in front of him and makes a second wager equal to the amount of his "21" wager. The dealer deals the player one additional card and the resulting three-card hand establishes that player's hand.

Another well-known procedure is splitting pairs. When the player's first two cards are a pair or of equal count, the player may "split" those cards into two separate hands. His original wager is applied to one of the hands and he makes an additional wager for the other hand, equal to his original "21" wager. The player receives a new second card for each of the hands and each hand is played separately.

As described above, the player can take Blackjack insurance. The mechanics of Blackjack insurance are described as follows. When the dealer's face-up card is an Ace, before any cards are drawn, players may make an "Insurance" bet. Each player can wager one-half of the amount of his "21" wager as insurance against the dealer having a blackjack, i.e. a two-card 21 count (an Ace and a 10 count card). If the dealer has a two-card 21 count, the player wins two-to-one on his "Insurance" bet. Also, when the dealer has a two-card 21 count, that round of the game is over and all players lose except those who also have a two-card 21 count. These players "push" with the dealer. If the dealer does not have a two-card 21 count, the player loses on his insurance bet and the round of the game continues.

Accordingly, it is an object of the present invention to provide a modified method of playing Blackjack that can make the game of Blackjack more interesting and exciting to the player. There is a need for a player to be able to have a choice of placing a side-bet that his hand will go over 21 after he has received a hit card. Such a bet would provide some protection to a player that he would recoup some of his loss on the regular bet if his hand goes over 21. Further, it would provide some encouragement for the player to keep playing even when he is having a bad streak of losing hands. Thus the player would not be induced to stop playing or go elsewhere to change his "luck". Therefore, this modified method of playing Blackjack could substantially increase the casino's profit from the game of Blackjack.

BlackJack Has Its Own Language

As used in this patent application, the following words have the following meanings ascribed to them:

"Bet"—money or chips wagered on the outcome of a hand or hands.

"Blackjack"—the Americanized name of Vingt-et-un (French) and/also means 10 count card plus an Ace, totaling 21 in the player's or the dealer's initial two-card hand.

"Break" or "Bust"—having cards totaling over 21.

"Chip Tray"—a flat open container on the table where the dealer's chips are held.

"Conventional Blackjack Game"—Blackjack as described In Scarne's Encyclopedia of Games pp. 276–282 and/or as described in this patent application.

"Conventional Blackjack Table"—table with a half-circle side for the players and a straight side for the dealer. The table is covered with a layout with indicia printed thereon and having a single "21" wager box imprinted in each player's station.

"Conventional "21" Wager Box"—a single rectangle or other identifiable area on a Blackjack table layout identified on the accompanying drawings as item 12, where a player places his conventional "21" wager.

"Conventional 21 Wager"—an initial 21 wager made in the conventional game of Blackjack. The payoff is usually one-to-one except when the player has a two card blackjack the payoff is 3-to-2.

"Casino"—a gaming establishment.

"Each Deal"—the dealing of one round of hands as described in Scarnes Encyclopedia of Games and/or as described herein.

"Dealer"—the person that deals the cards and conducts the game.

"Double Down"—The act of doubling the size of the bet and drawing one more card.

"Draw" or "Hit"—to take additional cards to add to the cards in the hand.

"Hole Card"—the dealer's face down or unexposed second card.

"Initial Hand"—the first hand dealt to the dealer and/or player on each round of hands.

"Initial 21 Wager(s)"—"21 " wagers made before the start of the deal. "Layout"—a design printed onto the playing surface of the Blackjack table and/or fabric table cover that shows the 21 wager boxes, Insurance wager box, and/or other information, i.e. "Blackjack Insurance Pays 2-TO-1", "Dealer draws to a soft 17".

"Natural"—initial two cards dealt including an Ace and a 10-value card. Considered an automatic winning hand unless compared to another Natural. Generally paid a bonus when received by the player of 1.5 to 1.

"Posted odds"—the payoff on a wager as shown on a table sign or as imprinted on the table layout.

"Push"—means tie, stand-off, no action. Push or tie hands are not counted as a hand being won or lost.

"Surrender"—Before taking a "hit", "surrender" is sometimes allowed. Some casinos permit the player to cancel his hand before he draws any cards by surrendering one-half of his wager.

"Table Sign"—a sign on the table that shows table wager limits and other information.

"Split"—to make two hands out of the original two-card pair or equal value cards.

"Station"—a designated area on a layout that has the player's wager boxes and where the dealer deals cards to the player and where winning wagers are paid.

"Stiff"—any hand between 12 and 16 in which the player or dealer has a chance of breaking.

"Wager"—money or chips wagered on the outcome of the hand to be or being played.

SUMMARY OF THE INVENTION

In a first aspect of the present invention, a method of playing Blackjack is disclosed wherein the player is given the option of placing a side bet that he will be broken when he receives hit cards. The method comprises the first step of assigning the player to a station at a Blackjack table, which is modified with the inclusion of indicia marked "Hit Insurance" at the player's station. The player is then required to make a regular Blackjack bet in order to receive a hand of cards and participate in the game. The dealer then deals the player a hand of cards. The dealer then deals himself/herself a hand of cards in which one card is placed with its face exposed (commonly referred to as the upcard or face card). If the player has a hand total between a first value of 12 and a second value of 16 and if the dealer's upcard shows a third value of seven through a fourth value of ace, the player is given the option of placing the side bet that he will be broken when he receives the hit card. Two variations for placing the side bet are provided in the first aspect of the invention.

In the first variation of the first aspect of the invention, the player makes the side bet before he requests a hit card. If the player makes 17 through 21 or stands on his hand, the side bet loses. If the hit card breaks the hand, the side bet wins and the regular bet loses. If the hit card results in a stiff hand (i.e., hard 12 through 16), the side bet loses and the regular bet stands. The player can then place another side bet wagering that he will be broken on the next hit. The player can keep on placing the side bet until he receives a pat hand (17 through 21), or is broken, or stands on the hand. The traditional rules of Blackjack are then used to determine if the player or the dealer has won the hand or if the game results in a push. A further variation may include the side bet pushing or receiving a payoff when the player receives a natural Blackjack.

In the second variation of the first aspect of the invention, the player also makes the side bet before he requests a hit card. If the first hit does not break the hand or result in a pat hand, the side bet is not lost. Rather, the player can request additional hit cards against the same side bet. The side bet is allowed to remain in play until the player is broken or makes 17 through 21 or stands on his hand. If the player stands on the hand, the traditional rules of Blackjack are used to determine if the player or the dealer has won the hand or if the game results in a push. As above, a further variation may include the side bet pushing or receiving a payoff when the player receives a natural Blackjack.

In another aspect of the present invention, a method of playing Blackjack is disclosed wherein the player is given the option of placing a side bet that he will be broken before he is dealt any cards. If the dealer's upcard is 2 through 6, the side bet pushes. (Otherwise, the player loses the side bet.) The player can then request hit cards until he makes 17 through 21, or stands on the hand, or is broken. If the hand is broken, the player wins on the side bet and loses on the regular bet. If the player stands on the hand, the traditional rules of Blackjack are used to determine if the player or the dealer has won the hand or if the game results in a push.

In a variation of the second aspect of the present invention, a method of playing Blackjack is disclosed wherein the player is given the option of placing a side bet that he will be broken before he is dealt any cards. However, in this variation, the side bet loses if the dealer's upcard is 2 through 6. (Otherwise the player keeps the side bet.) The player can then request hit cards until he makes 17 through 21 or stands on the hand or is broken. If the hand is broken, the player wins on the side bet and loses on the regular bet. If the player stands on the hand, the traditional rules of Blackjack are used to determine if the player or the dealer has won the hand or if the game results in a push.

In yet another variation of the second aspect of the present invention, Blackjack insurance is included in the side bet wager. This feature of the game provides an incentive for the player to make the side bet before he is dealt the hand.

In a further variation of the second aspect of the present invention, the rules of the game allows for the payment of a reduced payoff on the regular bet and larger payoff on the side bet.

In an additional variation of the second aspect of the present invention, the rules of the game allow for a random payoff to be made on the side bet. In this variation, the player who wins on the side bet is allowed to operate a mechanism that generates a random win amount. Thus the player has the potential of winning a larger amount than in the variations of the game described above.

In still a further variation of the second aspect of the present invention, the rules of the game allows for the early bet to be moved to the regular bet when the dealer has a 2 through 6 as an upcard. This variation of the game allows the player to increase his wager when he feels that the odds favor his hand.

BRIEF DESCRIPTION OF THE DRAWINGS

FIG. 2 is a flow chart representation of a Blackjack game according to the present invention in which a side bet is placed as hit insurance after the player sees his initial hand. The side bet is placed before every hit that the player requests after his initial hand. The side bet wagers that the hand will exceed 21 after the hit.

FIG. 3 is a flow chart representation of a Blackjack game according to the present invention, in which a side bet is placed as hit insurance after the player sees his initial hand. The side bet is only placed one time in the hand. The side bet wagers that the hand will exceed 21 after the hit. The side bet remains in place for multiple hits if the hit card produces another stiff hand.

FIG. 5 is a flow chart representation of a Blackjack game according to the present invention, in which a side bet is placed as hit insurance before the player is dealt his initial hand. The side bet also provides automatic Blackjack insurance. The side bet loses if the dealer has a 2–6 upcard.

DETAILED DESCRIPTION OF THE INVENTION

Figure 1:
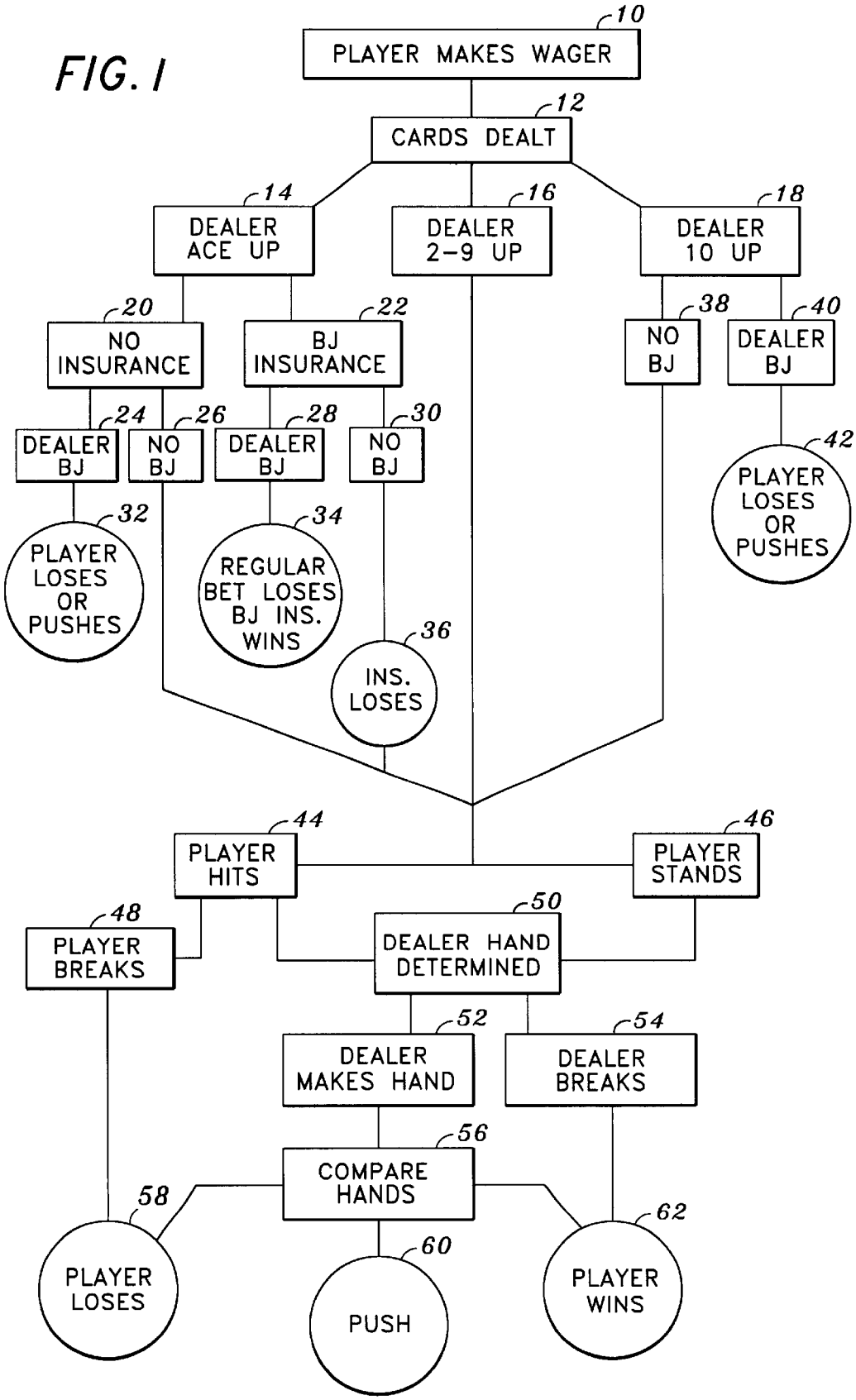
FIG. 1 is a flow chart representation of a Blackjack game of the prior art, which is played according to traditional rules.

The present invention is a modification of a traditional Blackjack game that offers the player the opportunity to place a side bet in addition to his main bet. This side bet is also referred to as "Hit Insurance" in this specification. Hit Insurance offers players the opportunity to win on the side bet if the player's hand total exceeds 21. The present invention can be implemented, for example, as a video game or a live table game.

A well-known strategy of playing Blackjack recommends that player should usually hit his hand, when the player has a "stiff" hand (i.e., hard 12 through 16) and the dealer has a seven through ace showing. However, this strategy creates the possibility that the player will "break" or "bust" (i.e. get a total greater than 21) and lose the hand. In the present invention, the player can make an additional bet (or side bet) that he will break his hand. If a hit card breaks the player's hand, the regular bet loses as normal, and the side bet wins. According to the present invention, the side bet can be made two basic ways. In the first way, the side bet is made before the cards are dealt to the player. This side bet is known as an "Early Bet". In the second way, the side bet is made after the player has seen his hand. This side bet is known as a "Late Bet". Additional strategies and betting opportunities can also be provided within the framework of the two basic ways of placing the side bet. These strategies and betting opportunities are described below.

Using the format and rules of traditional six or eight deck face up Blackjack, the side bet (or Hit Insurance) is played as an additional bet made either during the hitting sequence of the game or before any cards are dealt. However, a single deck may be used if only an Early Bet is allowed to be placed. After the initial two cards are dealt to all players and the dealer, and before the hitting sequence begins, the dealer checks his hole card, if the upcard is a Ten-valued card, for Blackjack. All other Blackjack rules, such as splitting, doubling down, Blackjack insurance, etc., remain the same as in the traditional Blackjack game.

The player can now bet that he will break his hand. If a hit card causes the player's hand to total over 21, the regular bet loses as normal, and the side bet wins. As noted above, the side bet can be made two ways:

The first way of making the side bet is the "Late Bet". The Late Bet is available after the players have seen their hands. If a player has (or hits into) a first value of 12 for example through a second value of 16 for example and the dealer has a third value of seven for example through a fourth value of ace for example as an upcard, the player may make an additional wager that he will break his hand. Once the Late Bet is made, it remains until the hand either wins by breaking, or loses by either standing or making a "pat" hand (17 through 21). Other variations of the Late Bet provide for a late bet play for each individual hit card. In such variations, higher payoffs can be offered for each individual card to make the game more exciting for the player and more lucrative for the casino. If the player breaks, the winning bet is paid odds based on the total points in the hand when the hit card is delivered. The wager may be any amount up to the amount of the original bet.

The second way in which the side bet may be made is the "Early Bet". In the early bet, the player makes the wager before any cards are dealt. The payoff can be much greater when the hand does break because it is rare for the player to have a stiff hand when the dealer's up card is a seven through ace card. In this situation, the payoff odds would be the same whether the hand is a 12 or 16 because the bet is made before any cards are dealt.

Other variations of the Early Bet can also be used in the present invention. For example, to provide an added incentive for the player to make the Early Bet, Blackjack Insurance can also be included in the Early Bet. Thus, the amount that is wagered in the Early Bet also includes the amount that would be wagered separately if the Blackjack Insurance bet was made. Therefore, no separate Blackjack Insurance bet needs to be made if the Early Bet is made. Thus the game can be structured so that if the player places an Early Bet, he will automatically have insurance against the dealer having a Blackjack, whether the upcard is a Ten or Ace. Further, Blackjack Insurance can be played as normal in addition to the Early bet.

For a better understanding of the present invention, reference is now made to FIGS. 1 to 7, which shows flow chart representations of the traditional Blackjack game and of the Blackjack game according to the present invention. The same numbers are used as references in these Figures to depict the same actions and results that occur during the different stages of the variations of the game as disclosed in this specification.

FIG. 1 is a flow chart representation of a traditional Blackjack game. The rules of the game are well known and were previously described in this specification under Background of the Invention.

FIG. 2 is a flow chart representation of the Blackjack game according to the present invention in which a Late Bet is allowed to be placed after the player has an opportunity to see his hand. As can be seen, most of the flow chart follows the flow chart of the traditional Blackjack game shown in FIG. 1. However, the version of the game shown in FIG. 2 gives the player the option of placing a Late Bet if the player has a stiff hand (i.e., a hard 12 to 16) and the dealer has a seven through ace showing. The player can make the Late Bet prior to each hit as long as the hit results in another stiff hand. The player can request hits until he or she breaks, or makes 17 through 21, or stands on his hand. This is shown by the closed loop between steps 110, 44, and 130 which are marked as "Make HI Wager", "Player Hits", and "Multiple Hits, Hit Insurance Loses," respectively. If after the first hit, the player's hand has not broken, he can then place a second Late Bet and request a second hit. The player can continue this sequence of actions until he is either broken or makes 17 through 21 or stands on his hand. If the player is broken as shown in step 48, he loses his regular bet and wins on the Late Bet as shown in step 120. If the player stands on his last hit or makes 17 through 21 as shown in step 135, then the game proceeds to step 50 and continues as described previously for the traditional game in FIG. 1.

FIG. 3 is a variation of the Blackjack game shown in FIG. 2. As in the variation of the game shown in FIG. 2, this variation also gives the player the option of placing a Late Bet if the player has a stiff hand (i.e., a hard 12 to 16) and the dealer has a seven through ace showing. However, in contrast to the variation of the game shown in FIG. 2, the player only places a Late Bet once. He can then request multiple hits until he or she breaks or makes a 17 through 21 or stands. This is shown by the bidirectional transaction flow arrows between steps 44 and 150, which are marked "Player Hits" and "Multiple Hits Hit Insurance Pushes" respectively. The player can place a Late Bet and request a first hit. If after the first hit, the player's hand has not broken, the Late Bet stays in place and the player can request a second hit. The player can request additional hits against the Late Bet until he is either broken, or makes 17 through 21, or stands on his hand. If the player is broken, he loses his regular bet and wins on the Late Bet as shown in step 120. If the player stands or makes 17 through 21 as shown in step 135, the game proceeds to step 50 and continues as described previously for the traditional game in FIG. 1.

Figure 4:
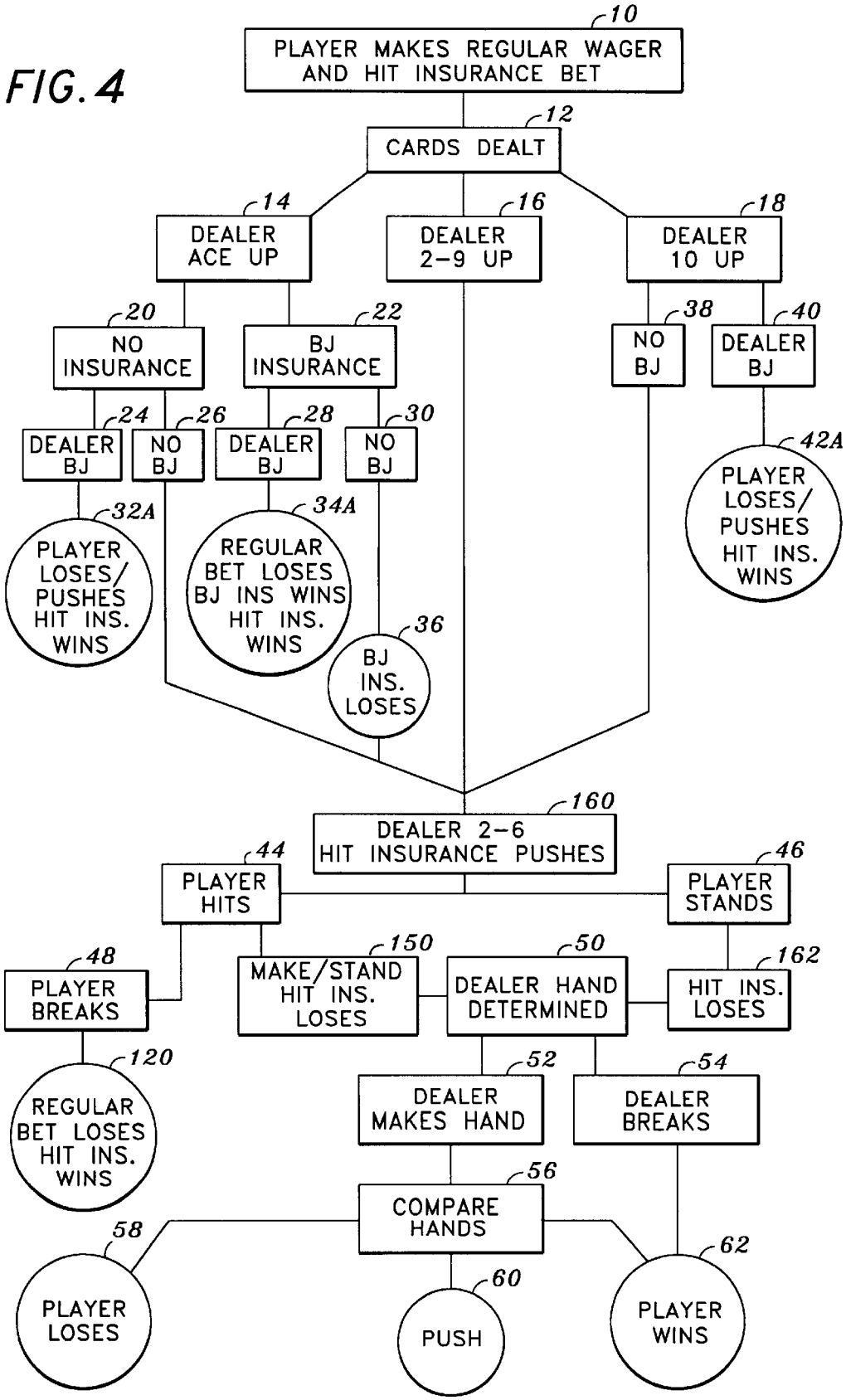
FIG. 4 is a flow chart representation of a Blackjack game according to the present invention, in which a side bet is placed as hit insurance before the player is dealt his initial hand. The side bet also provides automatic Blackjack insurance. The side bet pushes if the dealer has a 2–6 upcard.

FIG. 4 is a flow chart representation of another variation of the Blackjack game according to the present invention in which the player is allowed to place an Early Bet. As described above, an "Early Bet" is a side bet that the player places before he or she is dealt the cards. Further, this variation of the game provides for automatic Blackjack insurance to be included in the Early Bet. As described herein, automatic Blackjack Insurance means that the Side Bet amount acts as conventional Blackjack Insurance in the event that the dealer had an ace as an upcard. If the dealer does not have Blackjack, the Side Bet reverts to Hit Insurance. Thus steps 32, 34, and 42 of the traditional game are modified to show that the Hit Insurance wins. These modified steps are shown in FIG. 4 as steps 32A, 34A, and 42A respectively. Yet further, this variation provides for the Early Bet to push when the dealer's upcard shows 2 to 6 as depicted in step 160. The Early Bet remains in play if the dealer's upcard shows any other card. The player can then request hit cards in step 44 against the Early Bet until he is either broken, or makes 17 through 21, or stands on his hand. If the player stands without requesting additional cards as shown in step 46, he loses his Hit Insurance as shown in step 162. The game then proceeds to step 50 and continues as described previously for the traditional game in FIG. 1. If the player requests additional cards and is broken as shown in step 48, he loses his regular bet and wins on the Early Bet as shown in step 120. If the player stands on his hand or makes 17 through 21 as shown in step 150, then the game proceeds to step 50 and continues as described previously for the traditional game in FIG. 1.

FIG. 5 is a variation of the Blackjack game shown in FIG. 4. The flow sequence of the game generally follows the flow sequence of the game shown in FIG. 4. However, in this variation of the game, the Early Bet loses if the dealer's upcard shows 2 to 6 as shown in step 164.

Figure 6:
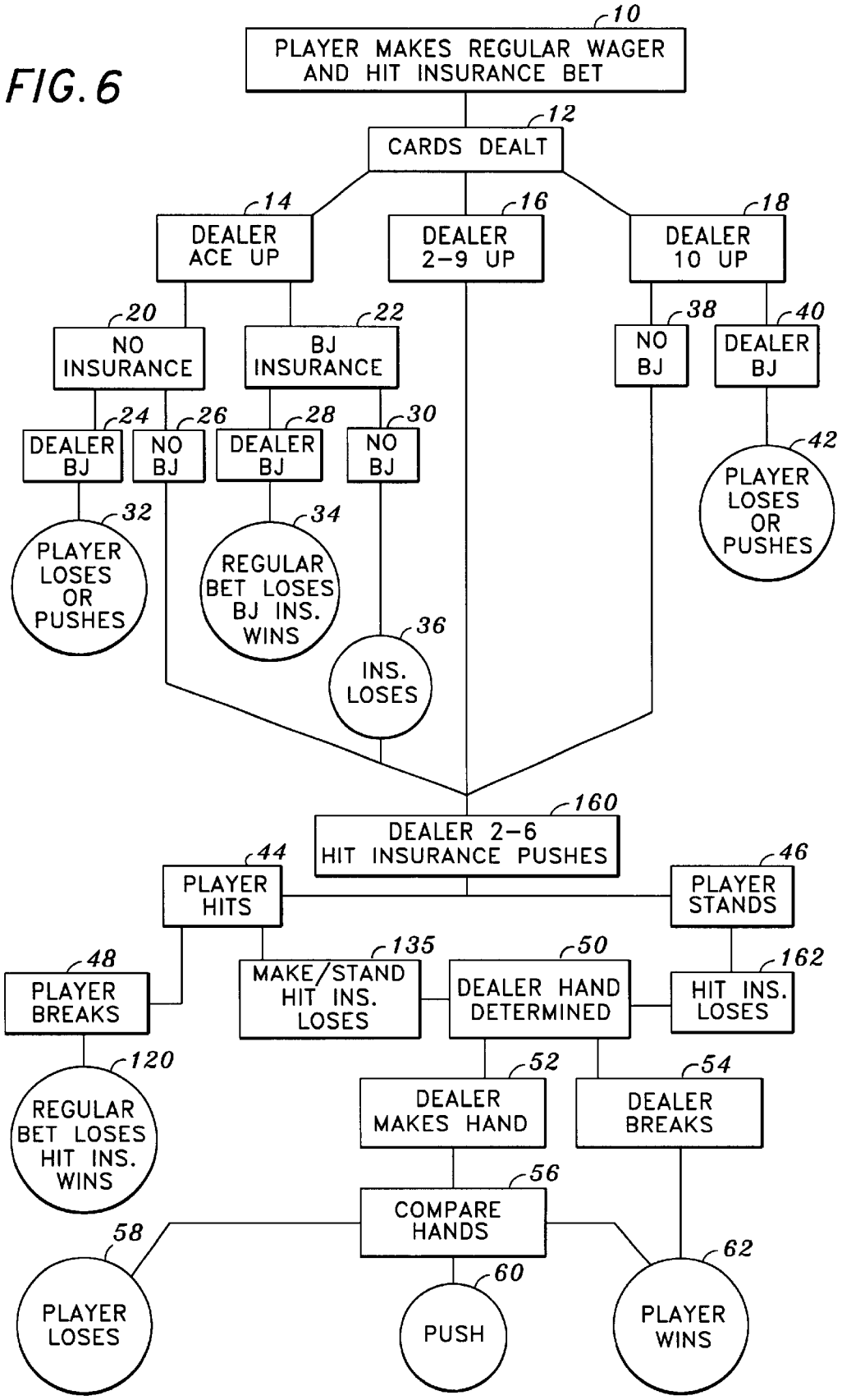
FIG. 6 is a flow chart representation of a Blackjack game according to the present invention, in which a side bet is placed as hit insurance before the player is dealt his initial hand. The side bet does not provide automatic Blackjack insurance, which is placed as a separate bet. The side bet pushes if the dealer has a 2–6 upcard.

FIG. 6 is a variation of the Blackjack game shown in FIG. 4 in which Blackjack insurance is not included in the Early Bet. Thus this variation of the game retains the original steps 32, 34, and 42 of the traditional game. As in the variation of the game shown in FIG. 4, the Early Bet pushes if the dealer's upcard shows 2 to 6 as shown in step 160.

Figure 7:
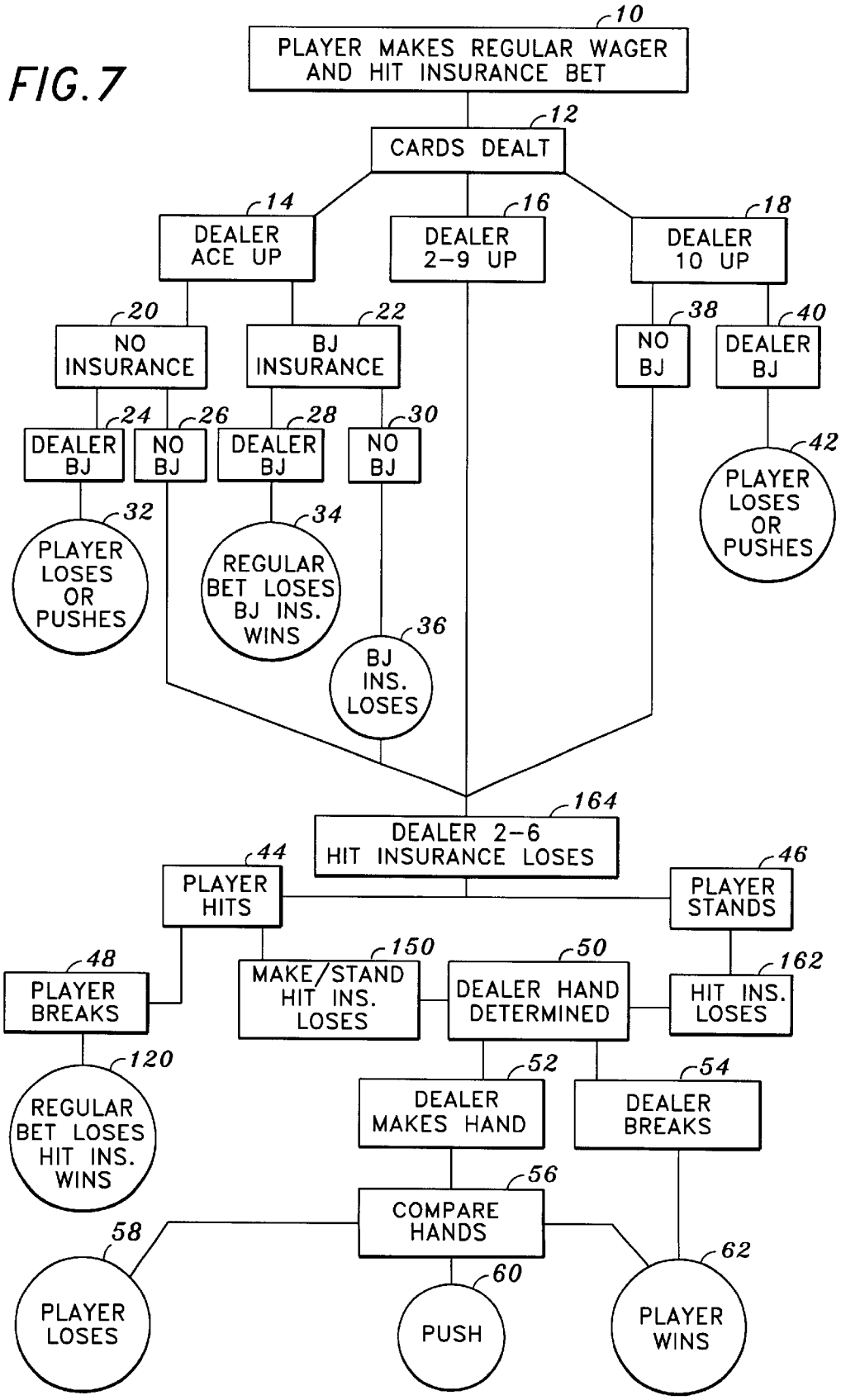
FIG. 7 is a flow chart representation of a Blackjack game according to the present invention, in which a side bet is placed as hit insurance before the player is dealt his initial hand. The side bet does not provide automatic Blackjack insurance, which is placed as a separate bet. The side bet loses if the dealer has a 2–6 upcard.

FIG. 7 is a variation of the Blackjack game shown in FIG. 6 in which the Blackjack insurance is not included in the Early Bet. As in the variation of the game shown in FIG. 6, the Early Bet loses if the dealer's upcard shows 2 to 6 as shown in step 164.

Yet other variations of the Blackjack game of the present invention are possible. Some of the other variations are briefly described below:

Version I: Late Bet—Single Card Decision (FIG. 2). In this version, the dealer begins to offer hit cards to the players in order after the initial cards have been dealt. If the dealer has a Seven through Ace showing and the player has a hard total of 12 through 16, or hits into a hard 12 through 16, they may choose to make a side wager that their next hit card will break their hand.

When the player is ready to take a "hit" card, they can place a side bet on the "Hit Insurance" bar of the Blackjack table up to the amount of the original bet. If the player's hand "breaks" after receiving a hit card, the regular wager loses (as normal) and the Hit Insurance bet wins. If the hand does not break, the Hit Insurance bet loses and play continues. If the player still has a stiff hand, they may opt to make another Hit Insurance wager.

As an example, assume that the player has 12 and takes Hit Insurance. If the player receives a 10 and breaks, he loses his original bet, but wins 2 to 1 on the side bet. If the player receives a deuce, the Hit Insurance bet loses, but the player could take another Hit Insurance bet on his new total of 14. If the player bets again and breaks, he receives a payoff, for example 1 to 1, on the side bet based on the total of 14 at the time of the bust. The payoff to the player can be based on the point value of the hand at the time of the bust. The payoff schedule can be optimized to maximize profits for the casino while still creating enough interest for the player to continue playing.

Version II: Late Bet—Multiple Card Hits (FIG. 3). In this variation, a single Hit Insurance wager is made. This single wager is allowed to remain for multiple hits if the hit card produces another stiff hand. The hit insurance bet stays until the player either breaks his hand, decides to stand, or makes a pat hand. As described above for Version 1, the payoff can be based on the point value of the hand at the time of the bust. Version 2 of the Blackjack game according to the present invention is believed to be more advantageous for the player as the wager loses less often in comparison to Version I.

Version III: Early Bet with Payoff Schedule and Blackjack Insurance: In a third version of the Blackjack game according to the present invention, the player makes a bet before the cards are dealt that he will break his hand. In this version, the payoff to the player on the side bet can be much higher because the odds are greater that the dealer has 7 through Ace showing and the player has a hitting hand. The bet remains as in Version II until the player either stands (loses the side bet), hits into a 17 through 21 (loses the side bet), or breaks (wins the side bet). If the dealer has a 2 through 6 as an upcard, the bet will either lose or push before any hit cards are delivered.

In addition, in order to make the bet more attractive in this version of the Blackjack game, an Early Hit Insurance bet could also include Blackjack insurance. This would be insurance against any dealer Blackjack when the dealer has either a Ten or an Ace as an upcard. If the dealer has an Ace showing, the player's bet would already act as Blackjack Insurance. Therefore, the player would not have to take regular Blackjack Insurance. If the dealer does not have a Blackjack, the bet remains and plays as Hit Insurance with the higher payoff chart.

However, in this version of the Blackjack game, the player could still opt to take regular Blackjack insurance along with their early bet if desired. As in Versions I and II described above, the payoff to the player on the side bet could be varied according the hand held by the player when he busts.

Version IV: Early Bet with Blackjack Insurance and Flat Payoff (FIG. 5). In this version of the Blackjack game according to the present invention, the side bet that the hand will be broken is made before the hands are dealt. Blackjack insurance is included in the side bet. However, in this version, the player is offered a flat payoff for breaking hands irrespective of the point value of the player's hand. For example, the payoff to the player can be 2 to 1 or 3 to 1. This version simplifies the game for the dealer as it eliminates the complex payoff schedule (which varies the payoff according to the hand held by the player when he busts) of the previous versions. This version also simplifies the decision making for the player, as the player would have an idea what to bet in proportion to his original bet.

In this version, the Blackjack insurance could be either eliminated (FIG. 7) or reduced depending on the house advantages generated. Ideally the payoff would be the same for a breaking hand as a winning hand when the dealer has a Blackjack in order to keep the game as simple as possible for the dealers and players.

Version V: Early Bet with Push on Dealer Upcard of 2 through 6 (FIGS. 4 and 6). Yet another version of the Blackjack game according to the present invention increases the attractiveness of the side bet to the player by allowing the Early bet to push when the dealer shows a 2 through 6 as an upcard. This version decreases the house advantage, but provides a greater incentive for a player to make the bet.

Version VI: Early Bet with Blackjack Insurance and Reduced Regular Bet Win. This version of the Blackjack game according to the present invention allows a winning Hit Insurance bet to be paid at a higher payoff schedule. In this version, the regular bet only wins half (or some other fractional portion) of the original bet if the player does not break and if the player beats the dealer's hand.

Version VII: Early Bet with Blackjack Insurance and Random Payoff Win. In this version of the Blackjack game according to the present invention, the player makes a minimal bet made before the hand is dealt that the player will break the hand. If the player hand breaks, he gets to operate a mechanism that generates a random win amount. This procedure gives the player the incentive of potentially winning a large jackpot for a minimal bet. For higher limit games, a larger minimum bet could be offered with a proportionally balanced random win.

Version VIII: Early Bet that Moves to Regular Bet on Dealer Upcard of 2 through 6. In yet another version of the Blackjack game according to the present invention, the side bet is moved to the regular bet when the dealer has a 2 through 6. This procedure keeps the side bet in play more often than the procedure of Version VI in which the side bet is pushed. This variation of the game will allow the player to "press" or increase his wager when the dealer's upcard indicates that the odds are in favor of the player winning his wager.

It will be obvious to one of ordinary skill in the art that the above examples of the Blackjack game according to the present invention are not all-encompassing. Yet other versions of the game can be developed using the principle of hit insurance introduced herein. The development of these versions is well within the capabilities of one of ordinary skill in the art.

Yet further, the above versions could be combined to create new versions of the Blackjack game according to the present invention. For example, any of the above Early bets could be played without the incorporation of the Blackjack insurance or combined with a Late Bet version. This variation of the Blackjack game can allow for the house advantage to be adjusted through different payoffs or by the elimination of the Blackjack insurance.

Yet further, additional versions of the Blackjack game according to the present invention could incorporate combinations of Versions I through VIII into one game. The player could have the option of combinations of bets. As the payoff schedule is higher for the one card hit (Version 1), the player may opt to play aggressively for the larger payoff or play more conservatively and still have the "insurance" of Version II with a smaller payoff. Also, variations of the Early Bet can be combined with different versions of the Late Bet offering the option of playing either version, or both on a single hand. This would offer the most strategies for the player, however would be more difficult for the dealer. This combination may be the preferred version for a video slot machine. Furthermore, a payoff could be associated with a situation where both a player and the dealer receive Blackjack. In such instance, a fixed payoff amount, fixed odds payoff, random payoff amount or a progressive payoff amount may be employed.

Thus it will be seen that the incorporation of Hit Insurance into Blackjack creates a game that may increase the volume and hold percentage of traditional Blackjack games, while offering more fun, strategy and entertainment for players. This modification of the Blackjack game could substantially increase the overall revenues for casinos while providing more options for the player.

It should be understood, of course, that the foregoing relates to preferred embodiments of the invention and that modifications may be made without departing from the spirit and scope of the invention as set forth in the following claims.

We claim:

1. A method of playing a version of Blackjack using at least one conventional deck of 52 playing cards, wherein each player may place conventional "21" wagers comprising the steps of:

requiring a player to place a conventional 21 wager in order to receive a hand of cards;

dealing the player a hand of cards;

dealing a dealer a hand of cards that is completed concurrently or after the player is dealt a hand of cards; and allowing the player the option of playing an initial side bet that he will break a hand total of 21 before or after the player receives an initial hand, this option being allowable if the player has a hand total between a first value and a second value and also if a dealer has a third value through a fourth value showing and the method further comprising:

requiring the player to lose the initial side bet if the player does not break a hand total of 21 after receiving a first hit card or if the player's hand of cards falls between a fifth value and a sixth value after receiving the first hit card.

2. The method of claim 1 further comprising allowing the player the option of making a subsequent side bet prior to each subsequent hit card if the player has a hand total between the first value and the second value wherein the subsequent side bet is that the player will be broken on each subsequent hit card and wherein the player loses the subsequent side bet if the player is not broken on a subsequent hit card or if the player's hand total falls between the fifth value and the sixth value after receiving a subsequent hit card.

3. The method of claim 2 wherein the player wins on the subsequent side bet and loses the conventional wager when the player's hand total exceeds 21 after receiving a subsequent hit card.

4. The method of claim 2 wherein the player loses the subsequent side bet and wins the conventional wager when the player's hand total equals 21 or less after receiving the first hit card and exceeds the dealer's hand total.

5. The method of claim 2 wherein the player loses the subsequent side bet when the player stands after receiving a subsequent hit card.

6. The method of claim 5 wherein the player wins the conventional wager if the player's hand value is greater than the dealer's hand or the dealer breaks or the player pushes, the player pushes if the dealer has an equal hand, and the player loses if the dealer has a winning hand.

7. The method of claim 1 wherein the player wins on the initial side bet and loses the conventional wager when the player's hand total exceeds 21 after receiving the first hit card.

8. The method of claim 1 wherein the player loses the initial side bet and wins the conventional wager when the player's hand total equals 21 or less after receiving the first hit card and exceeds the dealer hand total.

9. The method of claim 1 wherein the player loses the initial side bet when the player stands after receiving the first hit.

10. The method of claim 9 wherein the player wins the conventional wager bet if the player's hand value is greater than the dealer's hand or the dealer breaks or if the player pushes if the dealer has an equal hand or the player loses if the dealer has a hand whose total is closer to 21 than the hand held by the player.

11. The method of claim 1 wherein, as long as the player has a hand total between the first value and the second value, the player is allowed to take subsequent hits and the player loses the side bet if the player is not broken after receiving a subsequent hit card or if the player's hand falls between the fifth value and the sixth value after receiving a subsequent hit card, and the player keeps the side bet if the player's hand total falls between the first value and the second value after receiving a subsequent hit card.

12. The method of claim 11 wherein the player wins on the player's side bet and the player loses on the player's conventional wager when the player's hand exceeds 21 after receiving a subsequent hit card.

13. The method of claim 11 wherein the player loses the player's side bet and the player wins the player's conventional wager when the player's hand equals 21 or less after receiving a subsequent hit card and exceeds the dealer's hand total.

14. The method of claim 11 wherein the player loses the player's side bet when the player stands after receiving a subsequent hit card.

15. The method of claim 14 wherein the player wins the conventional wager if the player's hand value is greater than the dealer's hand or the dealer breaks, the player pushes the conventional wager if the dealer has an equal hand, and the player loses the conventional wager if the dealer has a hand whose total is closer to 21 than the hand held by the player.

16. The method of claim 1 wherein the player wins one of a fixed payoff amount, fixed odds payoff, random payoff amount and a progressive payoff amount when the player and the dealer receive a Blackjack.

17. A method of playing Blackjack using at least one conventional deck of 52 playing cards, wherein each player may place conventional "21" wagers, comprising the steps of:

requiring a player to place a conventional 21 wager in order to receive a hand of cards;

allowing the player the option of playing an initial side bet that the player will break a hand total of 21 when the player receives hit cards; wherein the cards are played in a traditional or "natural" sequence, whereby the order in which said cards are dealt and the blackjack basic strategy are not altered;

dealing the player a hand of cards;

dealing a dealer a hand of cards; and wherein the initial side bet pushes if the dealer has an upcard having a value of between a seventh and an eighth value and the initial side bet remains in play if the dealer does not have an upcard having a value between the seventh and the eighth value.

18. The method of claim 17 wherein the player receives Blackjack insurance against the dealer having a Blackjack when the dealer has an ace or ten value card facing up when the player places the initial side bet.

19. The method of claim 18 wherein the initial side bet loses if the dealer has an upcard having a value between a seventh and an eighth value and the initial side bet remains in play if the dealer does not have an upcard having a value between the seventh and the eighth value.

20. The method of claim 19 wherein the player is given hit cards and the initial side bet wins if the player's hand is broken after receiving a hit card.

21. The method of claim 19 wherein the player is given hit cards and the initial side bet loses if the player stands or makes 17 through 21 after receiving a hit card.

22. The method of claim 21 wherein the player wins the conventional wager if the player's hand value is greater than the dealer's hand or the dealer breaks, the player pushes the conventional wager if the dealer has an equal hand, and the player loses the conventional wager if the dealer has a hand whose total is closer to 21 than the hand held by the player.

23. The method of claim 19 wherein the payoff on the conventional wager follows traditional Blackjack pay-off rules and the payoff on the side bet is 3 to 1.

24. The method of claim 19 wherein the payoff on the conventional wager is reduced below the payoff according to traditional Blackjack pay-off rules and the payoff on the side bet is greater than 3 to 1.

25. The method of claim 18 wherein the payoff on the side bet is determined by the player being allowed to operate a mechanism that generates a random win amount.

26. The method of claim 17 wherein the player is given hit cards and the initial side bet wins if the player's hand is broken after receiving a hit card.

27. The method of claim 17 wherein the player is given hit cards and the initial side bet loses if the player stands or makes 17 through 21 after receiving a hit card.

28. The method of claim 27 wherein the player wins the conventional wager if the player's hand value is greater than the dealer's hand or the dealer breaks, the player pushes the conventional wager if the dealer has an equal hand, and the player loses the conventional wager if the dealer has a hand whose total is closer to 21 than the hand held by the player.

29. The method of claim 17 wherein the initial side bet pushes if the dealer has an upcard having a value between a seventh and an eighth value and the player's side bet remains in play if the dealer does not have an upcard having a value between the seventh and the eighth value.

30. The method of claim 29 wherein the player is given hit cards and the initial side bet wins if the player's hand is broken after receiving a hit card.

31. The method of claim 29 wherein the player is given hit cards and the initial side bet loses if the player stands or makes 17 through 21 after receiving a hit card.

32. The method of claim 31 wherein the player wins the conventional wager if the player's hand value is greater than the dealer's hand or the dealer breaks, the player pushes if the dealer has an equal hand, and the player loses if the dealer has a hand whose total is closer to 21 than the hand held by the player.

33. The method of claim 17 wherein the initial side bet loses if the dealer has an upcard having a value between a seventh and an eighth value and the initial side bet remains in play if the dealer does not have an upcard having a value between the seventh and the eighth value.

34. The method of claim 33 wherein the player is given hit cards and the side bet wins if the player's hand is broken after receiving a hit card.

35. The method of claim 33 wherein the player is given hit cards and the initial side bet loses if the player stands or makes 17 through 21 after receiving a hit card.

36. The method of claim 35 wherein the player wins the conventional wager if the player's hand value is greater than the dealer's hand or the dealer breaks, the player pushes if the dealer has an equal hand, and the player loses if the dealer has a hand whose total is closer to 21 than the hand held by the player.

37. The method of claim 17 wherein the payoff on the conventional wager follows traditional Blackjack pay-off rules and the payoff on the side bet is 1.5 to 1.

38. The method of claim 17 wherein the payoff on the conventional wager is reduced below the payoff according to traditional Blackjack pay-off rules and the payoff on the side bet is greater than 1.5 to 1.

39. The method of claim 17 wherein the player's side bet is moved to the player's conventional wager if the dealer has an upcard having a value between a seventh and an eighth value and the player's side bet remains in play if the dealer does not have an upcard having a value between the seventh and the eighth value.

40. The method of claim 17 wherein the initial side bet pushes or receives a payoff if the player has a natural Blackjack.

41. A method of playing a version of Blackjack using at least one conventional deck of 52 playing cards, wherein each player may place conventional "21" wagers comprising the steps of:

requiring a player to place a conventional 21 wager in order to receive a hand of cards;

dealing the player a hand of cards;

dealing a dealer a hand of cards that is completed concurrently or after the player is dealt a hand of cards; and allowing the player the option of playing an initial side bet that he will break a hand total of 21 before or after the player receives an initial hand, wherein the cards are played in a traditional or "natural" sequence, whereby the order in which said cards are dealt and the blackjack basic strategy are not altered.

42. The method of claim 41 further comprising:

allowing the player the option of making a the first bet and subsequent side bets prior to each hit card if the player has a hand total between a first value and a second value;

wherein the side bet is that the player will be broken on the next hit card and wherein the player loses the side bet if the player is not broken on the next hit card or if the player's hand total falls between a third value and a fourth value after receiving the next hit card.

43. The method of claim 42 wherein the player wins on the side bet and loses the conventional wager when the player's hand total exceeds 21 after receiving a subsequent hit card.

44. The method of claim 42 wherein the player loses the side bet and wins the conventional wager when the player's hand total equals 21 or less and exceeds the dealer hand total after receiving the hit card.

45. The method of claim 42 wherein, as long as the player has a hand total between the first value an the second value, the player is allowed to take subsequent hit cards and the player loses the side bet if the player is not broken after receiving a subsequent hit card or if the player's hand falls between the third value and the forth value after receiving a subsequent hit card, and the player keeps the side bet if the player's hand total falls between the first value and the second value after receiving the subsequent hit card.

46. The method of claim 45 wherein the player wins on the player's side bet and the player loses on the player's conventional wager when the player's hand exceeds 21 after receiving the subsequent hit card.

47. The method of claim 45 wherein the player loses the play r's side bet and the player wins the player's conventional wager when the player's hand equals 21 or less after receiving the subsequent hit card and exceeds the dealer's hand total.

48. The method of claim 40 wherein the player loses the player's side bet when the player stands after receiving the hit card.

49. The method of claim 48 wherein the player wins the conventional wager if the player's hand value is greater than the dealer's hand or the dealer breaks, the player pushes the conventional wager if the dealer has an equal hand, and the player loses the conventional wager if the dealer has a hand whose total is closer to 21 than the hand held by the player.

50. The method of claim 41 wherein the player loses the side bet when the player stands after receiving the hit card.

51. The method of claim 50 wherein the player wins the conventional wager if the player's hand value is greater than the dealer's hand or the dealer breaks or the player pushes if the dealer has an equal hand or the player loses if the dealer has a hand whose total is closer to 21 than the hand held by the player.

52. The method of claim 50 wherein the player wins the conventional wager if the player's hand value is greater than the dealer's hand or the dealer breaks, or the player pushes if the dealer has an equal hand, and the player loses if the dealer has a winning hand.

53. A method of playing Blackjack using at least one conventional deck of 52 playing cards, wherein each player may place conventional "21" wagers, comprising the steps of:

requiring a player to place a conventional 21 wager in order to receive a hand of cards;

allowing the player the option of playing an initial side bet, prior to receiving the player's hand, that the player will break a hand total of 21 when the player receives hit cards;

dealing the player a hand of cards;

dealing the dealer a hand of cards;

allowing the player the option of playing an initial side bet that he will break a hand total of 21 before or after the player receives an initial hand, this option being allowable if the player has a hand total between a first value and a second value and also if a dealer has a third value through a fourth value showing and the method further comprising:

requiring the player to lose the initial side bet if the player does not break a hand total of 21 after receiving a first hit card or if the player's hand of cards falls between a fifth value and a sixth value after receiving the first hit card.

54. A method as in claim 53 wherein the initial side bet pushes if the dealer has an upcard having a value of between a seventh and an eighth value and the initial side bet remains in play if the dealer does not have an upcard having a value between the seventh and the eighth value.

55. The method of claim 54 wherein the player is given hit cards and the initial side bet wins if the player's hand is broken after receiving a hit card.

56. The method of claim 54 wherein the player is given hit cards and the initial side bet loses if the player stands or makes 17 through 21 after receiving a hit card.

57. The method of claim 56 wherein the player wins the conventional wager if the player's hand value is greater than the dealer's hand or the dealer breaks, the player pushes the conventional wager if the dealer has an equal hand, and the player loses the conventional wager if the dealer has a hand whose total is closer to 21 than the hand held by the player.

58. The method of claim 54 wherein the payoff on the conventional wager follows traditional Blackjack pay-off rules and the payoff on the side bet is 1.5 to 1.

59. The method of claim 54 wherein the payoff on the conventional wager is reduced below the payoff according to traditional Blackjack pay-off rules and the payoff on the side bet is greater than 1.5 to 1.

60. The method of claim 53 wherein the initial side bet loses if the dealer has an upcard having a value between a seventh and an eighth value and the initial side bet remains in play if the dealer does not have an upcard having a value between the seventh and the eighth value.

61. The method of claim 60 wherein the player is given hit cards and the initial side bet wins if the player's hand is broken after receiving a hit card.

62. The method of claim 60 wherein the player is given hit cards and the initial side bet loses if the player stands or makes 17 through 21 after receiving a hit card.

63. The method of claim 60 wherein the player wins the conventional wager if the player's hand value is greater than the dealer's hand or the dealer breaks, the player pushes the conventional wager if the dealer has an equal hand, and the player loses the conventional wager if the dealer has a hand whose total is closer to 21 than the hand held by the player.

64. The method of claim 60 wherein the payoff on the conventional wager follows traditional Blackjack pay-off rules and the payoff on the side bet is 3 to 1.

65. The method of claim 60 wherein the payoff on the conventional wager is reduced below the payoff according to traditional Blackjack pay-off rules and the payoff on the side bet is greater than 3 to 1.

66. The method of claim 53 wherein the initial side bet pushes if the dealer has an upcard having a value between a seventh and an eighth value and the player's side bet remains in play if the dealer does not have an upcard having a value between the seventh and the eighth value.

67. The method of claim 66 wherein the player is given hit card and the initial side bet wins if the player's hand is broken after receiving a hit card and loses if the player stands or makes 17 through 21 after receiving a hit card.

68. The method of claim 67 wherein the player wins the conventional wager if the player's hand value is greater than the dealer's hand or the dealer breaks, the player pushes if the dealer has an equal hand, and the player loses if the dealer has a hand whose total is closer to 21 than the hand held by the player.

69. The method of claim 53 wherein the initial side bet loses if the dealer has an upcard having a value between a seventh and an eighth value and the initial side bet remains in play if the dealer does not have an upcard having a value between the seventh and the eighth value.

70. The method of claim 69 wherein the player is given hit cards and the side bet wins if the player's hand is broken after receiving a hit card.

71. The method of claim 69 wherein the player is given hit cards and the initial side bet loses if the player stands or makes 17 through 21 after receiving a hit card.

72. The method of claim 71 wherein the player wins the conventional wager if the player's hand value is greater than the dealer's hand or the dealer breaks, the player pushes if the dealer has an equal hand, and the player loses if the dealer has a hand whose total is closer to 21 than the hand held by the player.

73. The method of claim 53 wherein the payoff on the side bet is determined by the player being allowed to operate a mechanism that generates a random win amount.

74. The method of claim 53 wherein the player's side bet is moved to the player's conventional wager if the dealer has an upcard having a value between a seventh and an eighth value and the player's side bet remains in play if the dealer does not have an upcard having a value between the seventh and the eighth value.

75. The method of claim 54 wherein the initial side bet pushes or receives a payoff if the player has a natural Blackjack.

* * * * *